US009523066B2

(12) United States Patent
Krubasik et al.

(10) Patent No.: US 9,523,066 B2
(45) Date of Patent: Dec. 20, 2016

(54) CONTAINER FOR USE IN A WASHING PROCESS

(75) Inventors: Lucia Krubasik, Ludwigshafen (DE); Pavlinka Roy, Ludwigshafen (DE); Jordi Salvador, Barcelona (ES)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 346 days.

(21) Appl. No.: 13/982,328

(22) PCT Filed: Jan. 30, 2012

(86) PCT No.: PCT/GB2012/050183
§ 371 (c)(1),
(2), (4) Date: Oct. 8, 2013

(87) PCT Pub. No.: WO2012/104610
PCT Pub. Date: Aug. 9, 2012

(65) Prior Publication Data

US 2014/0299502 A1 Oct. 9, 2014

(30) Foreign Application Priority Data

Jan. 31, 2011 (GB) ..... 1101547.6

(51) Int. Cl.

| | |
|---|---|
| ***C11D 17/04*** | (2006.01) |
| ***A47L 15/44*** | (2006.01) |
| ***D06F 39/02*** | (2006.01) |
| *A47L 15/00* | (2006.01) |

(52) U.S. Cl.
CPC ..... *C11D 17/045* (2013.01); *A47L 15/4418* (2013.01); *A47L 15/4463* (2013.01); *A47L 15/4472* (2013.01); *D06F 39/02* (2013.01); *D06F 39/022* (2013.01); *A47L 15/0055* (2013.01)

(58) Field of Classification Search
USPC ..... 510/220, 295, 296, 439, 277; 206/524.7, 206/462, 466; 220/4.26, 4.27, 507
See application file for complete search history.

(56) References Cited

U.S. PATENT DOCUMENTS 4,776,455 A * 10/1988 Anderson ..... C11D 17/046 206/0.5
2002/0086806 A1 7/2002 Giblin
2010/0105596 A1 4/2010 Wiedemann

FOREIGN PATENT DOCUMENTS

| | | | |
|---|---|---|---|
| EP | 1375637 | A1 * | 1/2004 |
| GB | 2374580 | A | 10/2002 |
| GB | 2374582 | A | 10/2002 |
| WO | 0185895 | A1 | 11/2001 |
| WO | 03037741 | A1 | 5/2003 |

OTHER PUBLICATIONS

International Search Report and Written Opinion mailed Jun. 5, 2012 for priority application PCT/GB2012/050183.

* cited by examiner

*Primary Examiner* — J. Gregory Pickett
*Assistant Examiner* — Allan Stevens
(74) *Attorney, Agent, or Firm* — Troutman Sanders LLP; Ryan A. Schneider; Chris N. Davis

(57) ABSTRACT

A container having a plurality of compartments wherein at least one compartment comprises a solid detergent composition and at least one compartment comprises a detergent composition which is in the form of a liquid or a gel and wherein adjacent compartments are arranged in a non-superposed or non-superposable relationship.

14 Claims, 2 Drawing Sheets

CONTAINER FOR USE IN A WASHING PROCESS

CROSS-REFERENCE TO RELATED APPLICATIONS

Figure 1:
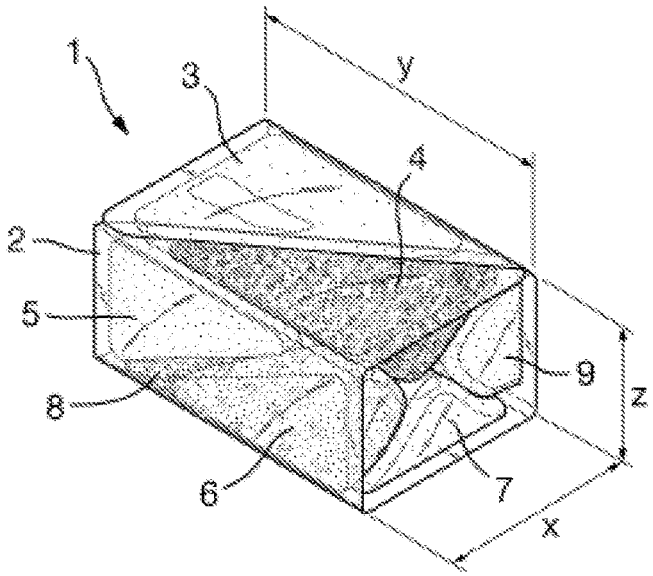

This application is a US National Stage of International Application No. PCT/GB2012/050183, filed 30 Jan. 2012, which claims the benefit of GB 1101547.6, filed 31 Jan. 2011, both herein fully incorporated by reference.

The present invention relates to a container which is used in a washing process. In particular the present invention relates to a container that is used in an automatic dishwashing process and in particular in a cleaning process for a dishwashing machine. The container comprises a plurality of water soluble compartments which dissolve in use to allow the contents of the compartments to be released. The container comprises at least three compartments.

Often, the required detergents/additives are administered as a compound tablet comprising a plurality of active ingredients. These may be kept separate for reasons of incompatibility. Alternatively or additionally they may be kept separate so that they may be activated at different points during a washing cycle or rinsing cycle. This activation at a particular point may be achieved by including time and/or temperature dependent released elements within the composition. One technique involves the coating or encasing of individual active components of the compound tablet within a water soluble polymer or gel of given properties/thickness to provide a time delayed and/or temperature dependent exposure to the component within so that it is exposed to the wash liquor within the ware washing machine at the desired point in a cycle.

In compound dosage elements of the type described above, individual active components may be in any state such as a solid, particulate or liquid form.

With the need to accommodate perhaps three or four active components within a single convenient dosage element, comes the complication of isolating each component from its' neighbour and providing the tablet within an overall compact package.

In addition, consumers are becoming increasingly reluctant to handle detergent compositions directly as there are perceived health/hygiene issues to doing so. With this in mind, it is desired to provide a barrier between the hand of the consumer and the ingredients of the dosage element and to reduce the risks of inadvertent exposure of the consumer to active ingredients of the tablet.

Containers are known for release of actives into washing machines such as laundry washing machines and automatic dishwashers. These containers typically have dispersible closures which disperse at a point in the washing cycle, with dispersion commonly triggered by heat causing melting of the closure material, typically a paraffin wax.

One problem associated with such containers is that they are limited in the types of compositions which can be included therein as to date they have generally been single compartment containers. It is frequently desirable to provide incompatible ingredients into a washing operation or to provide two or more formulations into a dishwashing process.

Another problem which has been encountered is the placement of the container. The container ideally needs to be placed in a secure locus where it will not cause problems with the operation of the dishwasher and where it will be able to release the actives contained therein. The preferred placement area has been in the cutlery basket of the dishwasher. A problem arises where the dishwasher does not have a conventional cutlery basket (wherein the cutlery is orientated in an upright manner). This is now an issue in an increasing number of machines that have cutlery trays (wherein the cutlery is orientated in a horizontal manner). These trays do not suit the location of a dispensing container as they cannot securely retain such a container.

According to a first aspect of the invention there is provided a container having a plurality of compartments wherein at least one compartment comprises a solid detergent composition and at least one compartment comprises a detergent composition which is in the form of a liquid or a gel and wherein adjacent compartments are arranged in a non-superposed or non-superposable relationship.

For the purposes of the present invention 'non-superposed' and 'non-superposable' mean that adjacent compartments are arranged such that they do not coincide with each other in all parts.

The container comprises at least three compartments in its interior for holding the contents of the container. The container can comprise up to ten individual compartments. Preferably the container has between three and eight compartments. Typically the container is provided with an even number of compartments. In a preferred embodiment the container comprises eight separate compartments.

Preferably each of the plurality of compartments is in the shape of a polyhedron. The polyhedron can be of a regular shape or an irregular shape. Each compartment can be individually selected to have the same or a different shape of polyhedron from the other compartments in the container. In a preferred embodiment each compartment can be paired with an adjacent compartment such that they have the same shape of polyhedron.

The polyhedron can comprise from four to twelve faces and have from six to thirty edges. In one preferred embodiment the polyhedron is an irregular polyhedron having five faces and eight edges. Each face having a triangular or quadrilateral shape with the proviso that at least one face has a quadrilateral shape.

In an alternative preferred embodiment there are three pairs of polyhedra in which two pairs comprise a polyhedron having a six faces and twelves edges and the third pair comprises a polyhedron having ten faces and twenty four edges.

Typically, the compartments are arranged in such a way that they are interleaved.

The volume of each of the plurality of compartments can be selected to be the same or different.

For the purposes of the present invention a polyhedron is a 3-dimensional shape having substantially straight edges and substantially flat faces; a face is defined as being a planar surface of a 3-D figure such as a polyhedron; and an edge is defined as being the intersection of two faces of a polyhedron.

The container preferably comprises a dishwashing or laundry composition, especially a machine cleaner dishwashing composition.

Each compartment of the container is a closed compartment, that is to say the contents of one compartment cannot pass to another compartment without the contents of the container being discharged. The compartments are provided to hold in isolation different formulations for example to avoid undesirable interactions between different ingredients in the products held within the container. The compartments can be individual, discreet compartments. Alternatively, adjacent compartment can share an interior wall, thus separating the internal space of the container into different compartments.

Typically the compartments of the container will each contain a different product formulation, namely products which are not identical in formulation. The product formulations held in the container (and in each compartment) may be of an suitable physical form such as a liquid, gel, powder or solid body depending upon the intended use of the product and container.

The compartments of the container can be provided with any suitable combination of solid, liquid or gel formulations.

In a preferred embodiment the container is provided with 8 compartments of which 6 compartments are provided with a solid formulation and 2 compartments are provided with a gel formulation.

Typically, the detergent composition comprises 60-80% solid material, and 20-40% liquid material. The detergent in the compartments comprises up to 70% of the total volume of the container.

The container of the invention may be of any shape provided that each compartment is made of a water-soluble film.

It is preferred that the container is of a substantially square or rectangular cross section (taken horizontally through the container when standing on its area of largest footprint), especially when it is to be used in an automatic dishwashing machine. In one embodiment of the present invention a substantially rectangular cross section is preferred as this can allow for the container to be placed either in the plate rack of the dishwashing machine or in most other positions within the machine. Alternatively the container may have a substantially triangular cross section although this is less preferred. A preferred shape of the container is substantially that of a square or rectangular cuboid, most preferably a rectangular cuboid.

In a preferred embodiment two side walls will generally be joined with two faces to form a skirt that envelops the compartments such that they project inwardly from the skirt.

In an alternative embodiment each of the side walls of the container will generally be joined together to form the container perimeter wall and typically the container will have two faces; a front face and a back face. Generally the face(s) of the container will be of a larger surface area than any of the side walls.

Alternatively the container can be in the form of an open strip comprising series of compartments in a non-superposable arrangement.

By the term 'water-soluble' as used herein is meant that materials used to make the container and the compartments thereof substantially dissolve in water somewhere at a temperature between 5° C. and 70° C.; that is the material first passes into solution at a temperature in this range when the temperature of the water is increased. Some water soluble materials are termed 'cold water soluble' and substantially dissolve at ambient temperatures (e.g. 20° C.). Other water soluble materials are termed 'warm water soluble' and substantially dissolve at elevated temperatures (e.g. 40° C. or 60° C.) but not at 20° C. Both types of materials are covered by the term 'water soluble' herein. A material is considered dissolved if at least 90% wt of the material passes into solution at that temperature, preferably at least 95% wt, most preferably at least 99% wt such as 100% wt.

By the term 'water-dispersible' as used herein is meant that the relevant portion of the container substantially disperses in water somewhere at a temperature between 5° C. and 70° C. with the effect that the material no longer forms a part of the container but rather is present as a dispersion in the surrounding water or wash liquor.

Any suitable water-soluble materials may be used to form the container and the compartments thereof provided they can produce the desired shape. It is especially preferred that the water-soluble material comprises, and preferably is, a plastics material. It is preferred that the water soluble material comprises a polymeric material. Preferably the water insoluble materials used to produce the container is/are deformable material(s) e.g. for ease of placement within the (dish)washing machine and the container is also preferably corresponding deformable.

Suitable water soluble materials include water soluble poly(vinyl alcohol)s; cellulose derivatives (such as an ether or hydroxypropyl methyl cellulose); poly(glycolide)s, poly (glycolic acid)s, poly(lactides), poly (lactic acid) and copolymer thereof. It is especially preferred that the water soluble material comprises polyvinyl alcohol which dissolves in water somewhere at a temperature between 5° C. and 70° C., preferably between 10° C. and 60° C., such as between 20° C. and 50° C. Mixtures of two or more water soluble materials may also be used.

The container may be formed by any suitable manner; for example injection moulding, extrusion, blow moulding, vacuum forming or thermoforming. Such processes are well known in the art and do not need to be described in detail herein. Preferably, the container is formed from a film of at least one water soluble material, preferably a flexible water soluble film. In this embodiment, a film of water soluble material, preferably polyvinyl alcohol, forms one or more face(s) or side wall(s) of the container. It is especially preferred that the container comprises at least one face formed from a water soluble film. According to a further embodiment of the present invention it is also preferred that the faces of the container are formed from a water soluble film, typically with most containers this will be the front face and back face where such faces are present.

The water soluble film of the container may be transparent, translucent or opaque. It is preferred that this part of the container is substantially transparent to allow the consumer to view the contents of the container, especially when the water soluble part of the container is a face.

According to one embodiment of the present invention different compartments in the container may be covered by water soluble material having different solubility characteristics. This allows for different formulations to be released from different compartments at different times during the washing operation in which the container is used.

The container may have any desired total volume (that is including the volume of all compartments in the container where there is more than one compartment). Typically the container will have a total volume in the range of from 1-50 ml, more preferably 5-35 ml, most preferably 10-30 ml such as 15-25 ml. Any combination of these ranges is also possible.

The compartment(s) may individually be of any suitable size/volume depending of the intended application for the container and its contents. The compartments preferably individually have a volume of from 1-10 ml, more preferably 2-5 ml. Any combination of these ranges is also possible.

The width of the container can be varied as desired. However, if the container is intended to be used in a dishwashing machine according to one embodiment of the invention, so that it can be placed in the plate rack of the machine, it is preferred that the container has a maximum width of 40 mm or less, preferably 35 mm or less. In a preferred embodiment the width of the container is 30 mm.

In one embodiment the container is shaped such that its maximum width is at or near the centre of the largest face of the container (the face having the two largest measurements, typically the length and height of the front face). In this case the container may be profiled so that container is narrower moving away from the centre. For example for a container having a maximum central width in the range of 30 mm-40 mm, an edge or all edges of the container may have a preferred maximum width of 30 mm.

In an alternative embodiment the container may have a largely constant width across its entire cross section, largely constant meaning in this context that the width does not vary by more than 20%, preferably by not more than 10%. For example for a container having a maximum central width of 30 mm may have an edge or all edges of the container with a preferred maximum width of 30 mm+/−20%, preferably +/−5%.

According to one embodiment of the invention the container preferably has a maximum length along its longest axis of 50 mm and more preferably at least 40 mm. In a preferred embodiment the length of the container is 40 mm. This allows for facile placement in a crockery rack of an automatic dishwasher. As such the maximum width:length ratio of the container is preferably less than 1:2.

Preferably the container has a maximum height of up to 30 mm, and more preferably up to 25 mm. In a preferred embodiment the height of the container is 22 mm.

In a most preferred embodiment the dimensions of the container are 40 mm×30 mm×22 mm (length×width×height).

In the event that the container is intended for use in a washing machine, it is preferred that the container has a length of 30 mm-40 mm, a width of 40-50, and a height of 30 mm-40 mm. In a most preferred embodiment the dimensions of the container are 36 mm×43 mm×35 mm (length×width×height).

The container may comprise any type of detergent composition and especially a dishwashing or laundry composition. It is especially preferred that the dishwashing composition is a dishwasher machine cleaner compositions. Where the container contains two or more compartments the compositions each compartment will typically contain a different formulation; for example one compartment may comprise an acidic formulation for the removal of lime-scale and another compartment may comprise a surfactant based formulation to remove grease residues.

The products inside the compartment(s) of the container may be in any suitable form as given above. However according to one embodiment it is preferred that the compositions are in a liquid or gel form. The compositions may be detergent formulations, rinse aid formulations or machine cleaner formulations. According to one embodiment of the invention machine cleaner formulations are preferred.

If the container is for use in the application of a liquid formulation to an automatic dishwasher, e.g. a liquid detergent such as a dishwasher machine cleaner any suitable formulation may be used. For example such a formulation is described in European application EP-A-1824755, the contents of which are incorporated by reference.

According to a second aspect of the present invention there is provided the use of a container according to the invention in a washing operation, especially in an automatic dishwashing machine cleaning operation.

The containers of the present invention provide for different compositions to be used in a washing process without having to provide more than one container. It also allows for the consumer to place the container directly into the appliance in which it is to be used without having to prepare the container for use. Also according to some embodiments the container can be placed within a plate rack of an automatic dishwasher. This allows for greater flexibility in the number of loci of placement of the container, especially in that the container does not require its own bespoke place for placement. Additionally by placement of the container with a crockery rack (between the pins of same) supplementary stability is offered to the container which eliminates the risk of damage to the dishwasher and any dishwasher contents.

The container may be used for the provision of materials to any washing process involving water, in particular in a laundry or dishwashing process. It is especially preferred that the container is used as part of an automatic dishwashing process. Such processes include wash cycles intended to clean the (dish)washing machine. It is especially preferred according to the present invention that the container is used an automatic dishwashing cycle for cleaning the dishwashing machine itself, especially by the removal of lime-scale and/or fatty deposits. The products used in such dishwashing applications are typically referred to as machine cleaner formulations.

In use the container may be placed in any suitable orientation provided that the orientation used allows its contents to be delivered upon contact with water during the washing process. Typically in a dishwashing machine the container will be placed either in the plate or in the non-rack area where cups etc are generally placed.

Figure 2:
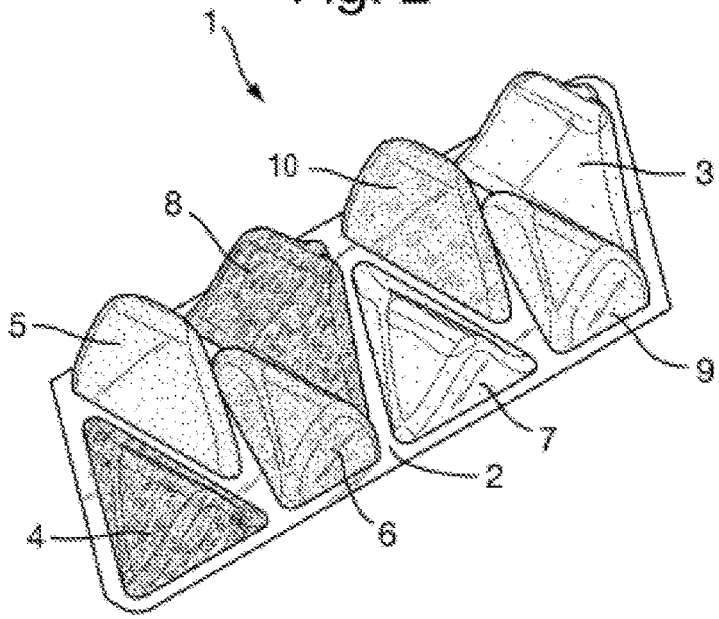
Figure 3:
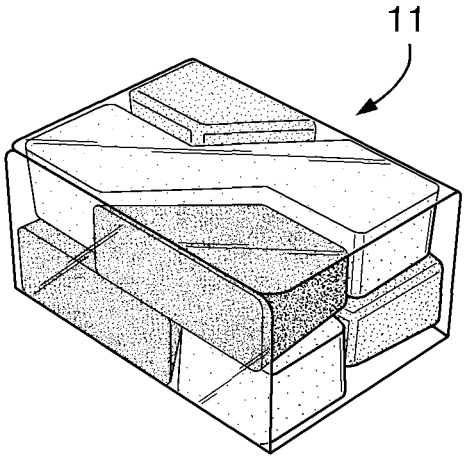
Figure 4:
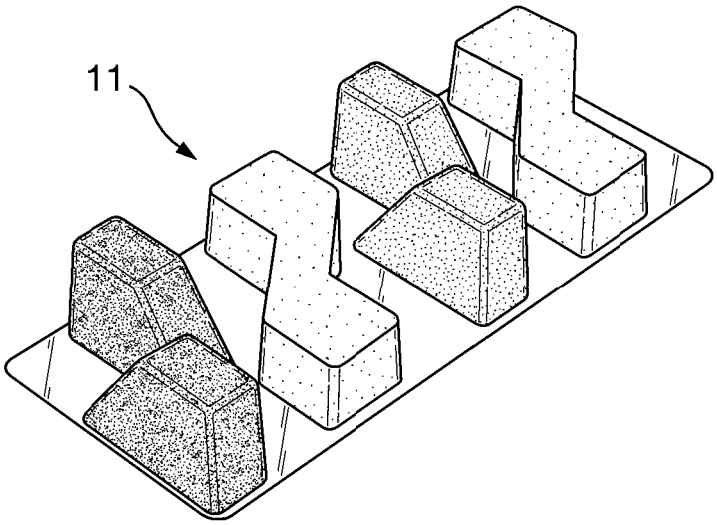

The invention will now be described with reference to the following non-limiting Figures, in which:

FIGS. 1 and 2 represent a container in accordance with the invention in both folded (FIG. 1) and unfolded (FIG. 2) configurations; and FIGS. 3 and 4 represent an alternative container in accordance with the invention in both folded (FIG. 3) and unfolded (FIG. 4) configurations.

FIGS. 1 and 2 show a container 1. The container is a rectangular cuboid. The cuboid is shaped such that it has a given maximum width (x), length (y) and height (z).

The container comprises a perimeter frame of water soluble material (2), and compartments (3)-(10). In the embodiment shown in FIG. 1 the compartment (10) is not shown, but as can be seen from FIG. 2 compartment (10) has the same dimensions as compartment (5). Each compartment is formed by the material of the external perimeter and an internal film of water soluble material (not shown). The internal film is a single piece of film which forms the internal wall for each of the compartments. Each of compartments (3)-(10) contain either a liquid formulation or a formulation in any other suitable physical form.

FIGS. 3 and 4 show an alternative embodiment (11) of the container of the present invention.

The container can be made in the following way. A film of PVOH is stretched across a mould having a defined number of cavities. The film is then heated until it softens. A vacuum is applied and the film is drawn into the cavities to form the compartments in the final product. Each compartment is then filled with a detergent formulation or any suitable formulation containing the desired active, for example a bleach, which is in the form of a powder which can be pre-compressed, liquid or gel depending on which compartment is being filled. A second film of PVOH is stretched across the top of the first film thus covering the filled compartments. Excess air is removed from each compartment and the films are sealed together to form seams between each compartment. The unfolded multi-compartment product is removed from the mould and rolled or folded-up into its final configuration. Any required sealing to keep the container in its folded configuration is now done. The sealing can be done using a glue or any other suitable system.

In an alternative method, air is removed before the second film is stretched across the compartments, for example by compressing the formulation within the compartment and filling with further of the same formulation.

An example of the formulation which can be used in each compartment is shown below. Table 1 lists the total weight of each component in the container. Table 2 lists the relative proportion of each component in a particular formulation. As can be seen from Table 2, a container in accordance with the present invention can have 8 compartments—6 compartments containing a solid formulation, and 2 containing a liquid or gel formulation. Different combinations of solid and liquid/gel formulations can be used as required.

TABLE 1

| Component | Weight |
|---|---|
| Sodium Tripolyphosphate | 6.946435 g |
| Sodium Carbonate | 0.59555 g |
| Sodium Percarbonate | 3.00355 g |
| Tetra Acetyl Ethylene Diamine | 0.75895 g |
| Protease | 0.5504 g |
| Amylase | 0.06966 g |
| Sulfonated polymer | 1.499109 g |
| Perfume | 0.01161 g |
| Non-ionic Surfactant | 2.58 g |
| Citric acid coated Mn acetate | 0.112445 g |
| Tolyltriazole | 0.046741 g |
| tetrasodium 1 hydroxyethylidene biphosphonate | 1.0019 g |
| silicone, polydimethyl siloxane | 0.02365 g |
| Total Weight | 17.2 g |

The invention claimed is:

1. A container comprising a plurality of compartments each made of water-soluble film;

wherein at least one compartment comprises a solid detergent composition and at least one compartment comprises a non-solid detergent composition;

wherein adjacent compartments are arranged in a non-superposed or non-superposable relationship;

wherein the container is made from an open strip comprising the compartments, which strip has been folded or rolled into its final configuration, said open strip comprising an internal film being a single piece of film forming at least one internal wall for each of the compartments, and an external perimeter film forming at least one external wall for each of the compartments; and wherein the compartments are arranged in such a way that they are interleaved.

2. The container as claimed in claim 1, wherein the container has a folded and unfolded configuration, and in its folded configuration comprises at least three compartments in its interior for holding contents of the container.

3. The container as claimed in claim 1, wherein the container comprises from three to ten separate compartments;

wherein in use, the container is subjected to a liquid comprising water;

wherein at least a portion of the compartments is formed of a water-soluble material;

wherein each compartment comprising a detergent composition is a closed compartment such that contents of one compartment cannot pass to another compartment prior to exposure of the container to a liquid comprising water; and wherein upon use, at least portions of the water-soluble portions of the compartments dissolve to allow contents of the compartments to be released.

TABLE 2

| Compartment | Gel (1) | Gel (2) | Powder (1) | Powder (2) | Powder (3) | Powder (4) | Powder (5) | Powder (6) |
|---|---|---|---|---|---|---|---|---|
| Sodium tripolyphosphate | | 7.00 | | | 59.335 | 83.825 | 73.065 | 99.865 |
| Sodium carbonate | | | 27.70 | | | | | |
| Sodium percarbonate | | | 72.30 | 67.40 | | | | |
| Tetra Acetyl Ethylene Diamine | | | | | 35.30 | | | |
| Protease | | | | | | 12.80 | 12.80 | |
| Amylase | | | | | | 3.24 | | |
| Sulfonated polymer | 37.826 | 31.90 | | | | | | |
| Perfume | | | | | 0.135 | 0.135 | 0.135 | 0.135 |
| Surfactant | 60.000 | 60.00 | | | | | | |
| Citric acid coated Mn acetate | | | | | 5.23 | | | |
| Tolyltriazole | 2.174 | | | | | | | |
| Tetrasodium 1 hydroxyethylidene biphosphonate | | | | 32.60 | | | 14.00 | |
| Silicone, polydimethyl siloxane | | 1.1.00 | | | | | | |
| Total (%) | 100.00 | 100.00 | 100.00 | 100.00 | 100.00 | 100.00 | 100.00 | 100.00 |

The container of the present invention allows for greater control of the detergents which can be used in a washing process. For example, it is possible to include a different detergent in each compartment, i.e. a container having 6 compartments could have 6 different detergents.

Further modifications and improvements can be made without departing from the scope of the invention described herein.

4. The container as claimed in claim 1, wherein the container comprises between six and eight separate compartments.

5. The container as claimed in claim 1, wherein the container comprises eight separate compartments.

6. The container as claimed in claim 1, wherein each of the plurality of compartments is in the shape of a polyhedron.

7. The container as claimed in claim 6, wherein at least one polyhedron is of an irregular shape.

8. The container as claimed in claim 7, wherein at least one compartment is individually selected to have a different shape of polyhedron from at least one of the other compartments in the container.

9. The container as claimed in claim 6, wherein each polyhedron comprises from four to twelve faces and has from six to thirty edges.

10. The container as claimed in claim 1, wherein the detergent compositions comprise machine cleaner dishwashing compositions.

11. A container comprising a plurality of separate compartments;

wherein at least two compartments of the plurality of separate compartments comprise a detergent composition;

wherein adjacent compartments of the plurality of separate compartments are arranged in a non-superposed or non-superposable relationship;

wherein in use, the container is subjected to a liquid comprising water;

wherein at least a portion of each of the at least two compartments comprising the detergent composition is formed of a water-soluble material;

wherein each of the at least two compartments comprising the detergent composition is a closed compartment such that contents of one compartment cannot pass to another compartment prior to exposure of the container to a liquid comprising water;

wherein upon use, at least a portion of the water-soluble portions of the at least two compartments dissolve to allow contents of the at least two compartments to be released;

wherein the container is made from an open strip comprising the plurality of separate compartments, which strip has been folded or rolled into its final configuration, said open strip comprising an internal film being a single piece of film forming at least one internal wall for each of the plurality of separate compartments, and an external perimeter film forming at least one external wall for each of the plurality of separate compartments; and wherein the plurality of separate compartments are arranged in such a way that they are interleaved.

12. The container as claimed in claim 11, wherein at least one compartment of the at least two compartments comprises a detergent composition that is different from the detergent composition in another compartment.

13. The container as claimed in claim 11, wherein the detergent composition is selected from the group consisting of dishwashing detergent composition, laundry detergent composition, dishwasher machine cleaner composition, a detergent composition with an acidic formulation, a detergent composition with a surfactant-based formulation, a solid detergent composition, a liquid detergent composition, a gel detergent composition, and combinations thereof.

14. The container as claimed in claim 13, wherein each compartment of the at least two compartments comprises a different detergent composition from one another.

* * * * *